US007111339B2

(12) United States Patent
Chen

(10) Patent No.: US 7,111,339 B2
(45) Date of Patent: Sep. 26, 2006

(54) BASSINET HAVING COMPARTMENTS

(75) Inventor: Shun-Min Chen, Taipei Hsien (TW)

(73) Assignee: Wonderland Nurserygoods Co., Ltd., (TW)

( * ) Notice: Subject to any disclaimer, the term of this patent is extended or adjusted under 35 U.S.C. 154(b) by 0 days.

(21) Appl. No.: 10/831,797

(22) Filed: Apr. 26, 2004

(65) Prior Publication Data

US 2005/0144717 A1 Jul. 7, 2005

(30) Foreign Application Priority Data

Jan. 6, 2004 (CN) ..... 2004 2 0001502

(51) Int. Cl.
*A47D 7/04* (2006.01)
*A47D 13/06* (2006.01)

(52) U.S. Cl. ..... 5/93.1; 5/93.2

(58) Field of Classification Search ..... 5/93.1, 5/93.2, 97, 98.1, 99.1, 655, 94, 101, 102; D6/390, 391
See application file for complete search history.

(56) References Cited

U.S. PATENT DOCUMENTS

| | | | | |
|---|---|---|---|---|
| 2,992,440 | A * | 7/1961 | Revolt | 5/93.1 |
| 3,487,479 | A * | 1/1970 | Grooms | 5/93.1 |
| 5,867,850 | A * | 2/1999 | Mariol | 5/93.2 |
| D407,915 | S * | 4/1999 | Mariol et al. | D6/391 |
| D429,929 | S * | 8/2000 | Benson | D6/503 |
| 6,192,535 | B1 * | 2/2001 | Warner et al. | 5/93.1 |
| 6,539,563 | B1 * | 4/2003 | Hsia | 5/93.2 |
| 7,017,203 | B1 * | 3/2006 | Chen | 5/93.1 |
| 2003/0070230 | A1 * | 4/2003 | Hsia | 5/95 |
| 2005/0144717 | A1 * | 7/2005 | Chen | 5/93.1 |
| 2006/0021134 | A1 * | 2/2006 | Chen | 5/93.1 |

* cited by examiner

*Primary Examiner*—Robert G. Santos
(74) *Attorney, Agent, or Firm*—Scully, Scott, Murphy & Presser, P.C.

(57) ABSTRACT

A bassinet having compartments is provided. The bassinet can be hung on a baby play yard and comprises a peripheral main body and an inner partition, which is characterized in that the inner partition is adapted to divide the peripheral main body into a baby sleeping space and peripheral compartments for receiving articles.

With the above arrangement, a user can still dispose the necessaries for the baby in the peripheral compartments on the bassinet even when the baby lies thereon. Since the compartments and the baby sleeping space are in the same plane as the bottom of the bassinet, it is convenient for the user to take the articles without lifting the bassinet.

4 Claims, 4 Drawing Sheets

BASSINET HAVING COMPARTMENTS

FIELD OF INVENTION

The present invention relates to a bassinet hung on a baby play yard, and more particularly, to a bassinet having compartments.

BACKGROUND OF THE INVENTION

Many kinds of bassinet structures are already well known (as shown in FIG. 1A) and most of them are in the form of a rectangular construction. A baby can lie on such kind of bassinet and be taken care by his parents or babysitter. However, among the existing bassinet structures, only one baby sleeping space is provided on the bassinet without forming any further compartments. Since there are plenty of articles necessary for a baby, such as feeding bottle, diapers, towels, clothes, toys or the like, there is a shortcoming in having insufficient space for accommodating these articles when using the above kind of bassinet. As a result, some other kinds of bassinets have been proposed, in which the necessaries for the baby can be disposed in a space formed between the bassinet and the baby play yard. However, if the necessaries for the baby are disposed under the bassinet, it is more or less inconvenient for a user to get these articles.

Further, as shown in FIG. 1B, U.S. Pat. Nos. 6,539,563 and 6,192,535 each disclosed a bassinet structure for a baby play yard, in which the bassinet is mainly divided into left and right portions, i.e. a baby sleeping space M and a compartment N for receiving articles, respectively. However, such division of bassinet limits the length of a baby to be shorter than the width of the bassinet. That is to say, such bassinet is not suitable to a baby whose length is longer. In addition, such division of bassinet is more complicated in structure and thus results in a higher cost. Therefore, there is a need to provide a bassinet capable of receiving articles, easy to get articles and low in cost.

SUMMARY OF THE INVENTION

In view of the above drawbacks of conventional bassinets, the present invention is achieved by the diligence and experience of the applicant. The object of this invention is to provide a bassinet having compartments, which is adapted for accommodating articles and easily taking the articles out.

According to one aspect of this invention, a bassinet having compartments is provided. The bassinet can be hung on a baby play yard and comprises a peripheral main body and an inner partition, which is characterized in that the inner partition is adapted to divide the peripheral main body into a baby sleeping space and peripheral compartments for receiving articles.

With the above arrangement, the bassinet having compartments according to this invention has the following advantages. A user can still dispose the necessaries for the baby in the peripheral compartments on the bassinet even the baby lies thereon. Since the compartments for receiving articles and the baby sleeping space are in the same plane as the bottom of the bassinet, it is convenient for the user to take the articles without lifting the bassinet.

BRIEF DESCRIPTION OF THE DRAWINGS

The structure, features and functions of this invention will be described in detail with reference to the following description together with the accompanying drawings, in which.

DETAILED DESCRIPTION OF THE PREFERRED EMBODIMENT

This invention will be described with reference to the accompany drawings.

Figure 1A:
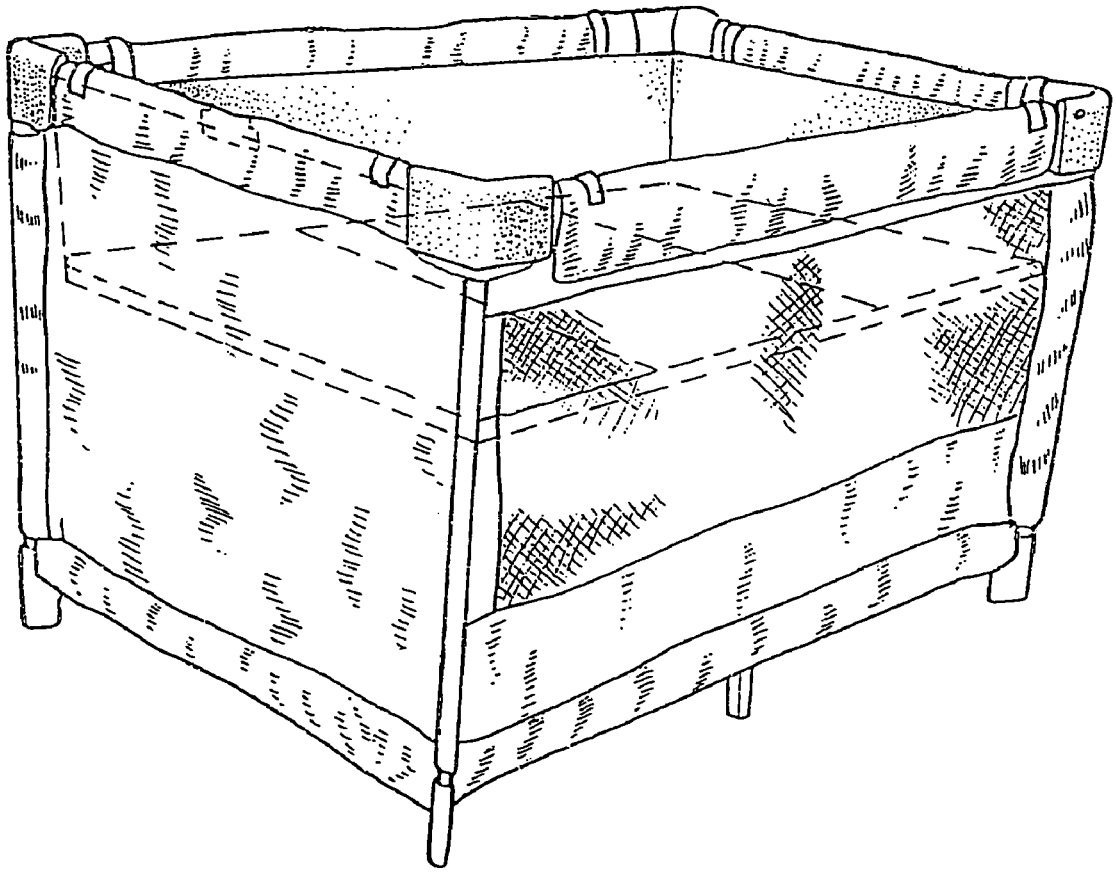
FIG.1A PRIOR ART
FIG. 1A is a perspective view showing a conventional bassinet hung on a baby play yard, in which the bassinet is not provided with any compartments for receiving articles.
Figure 1B:
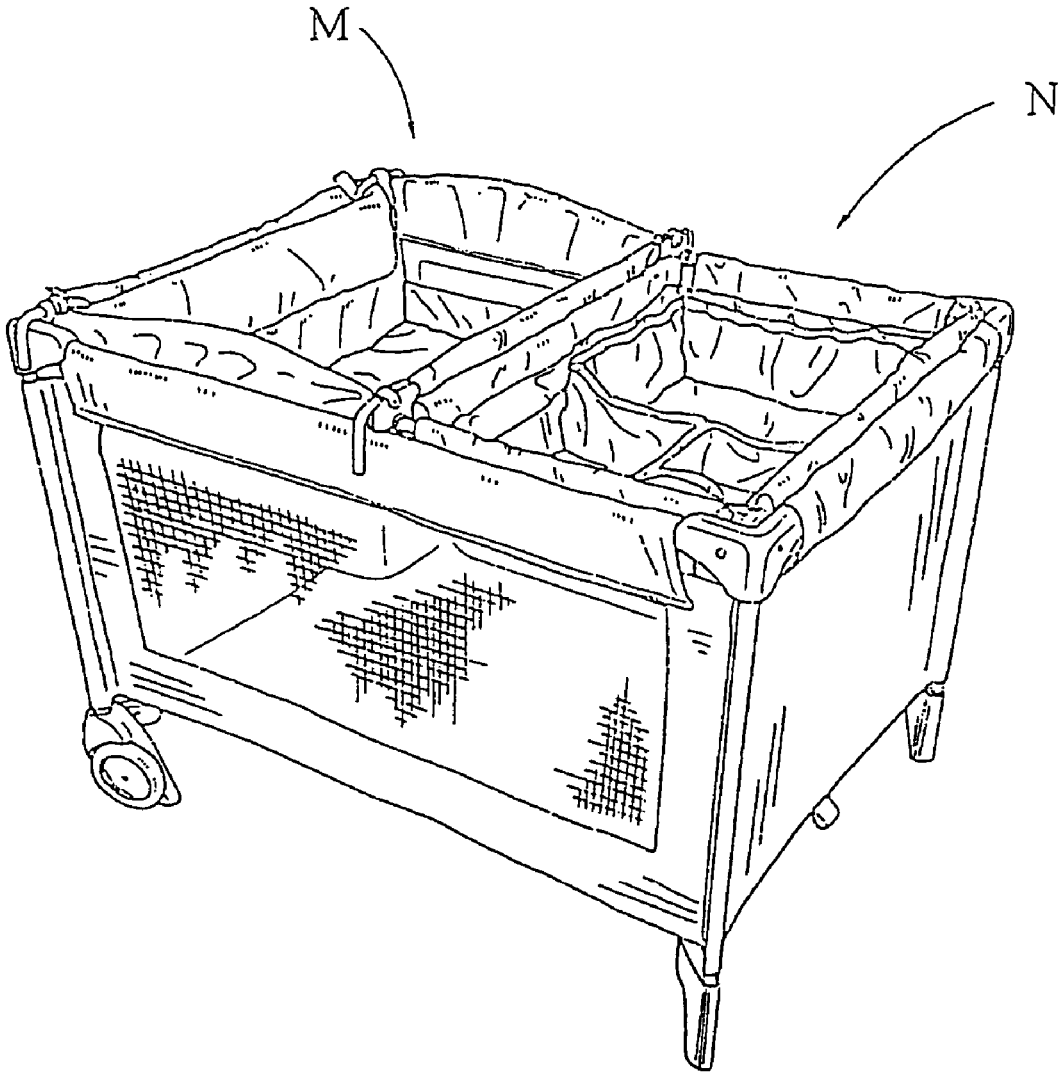
FIG.1B PRIOR ART
FIG. 1B is a perspective view showing a conventional bassinet hung on a baby play yard, in which the bassinet is divided into a baby sleeping space and a compartment for receiving articles.
Figure 2:
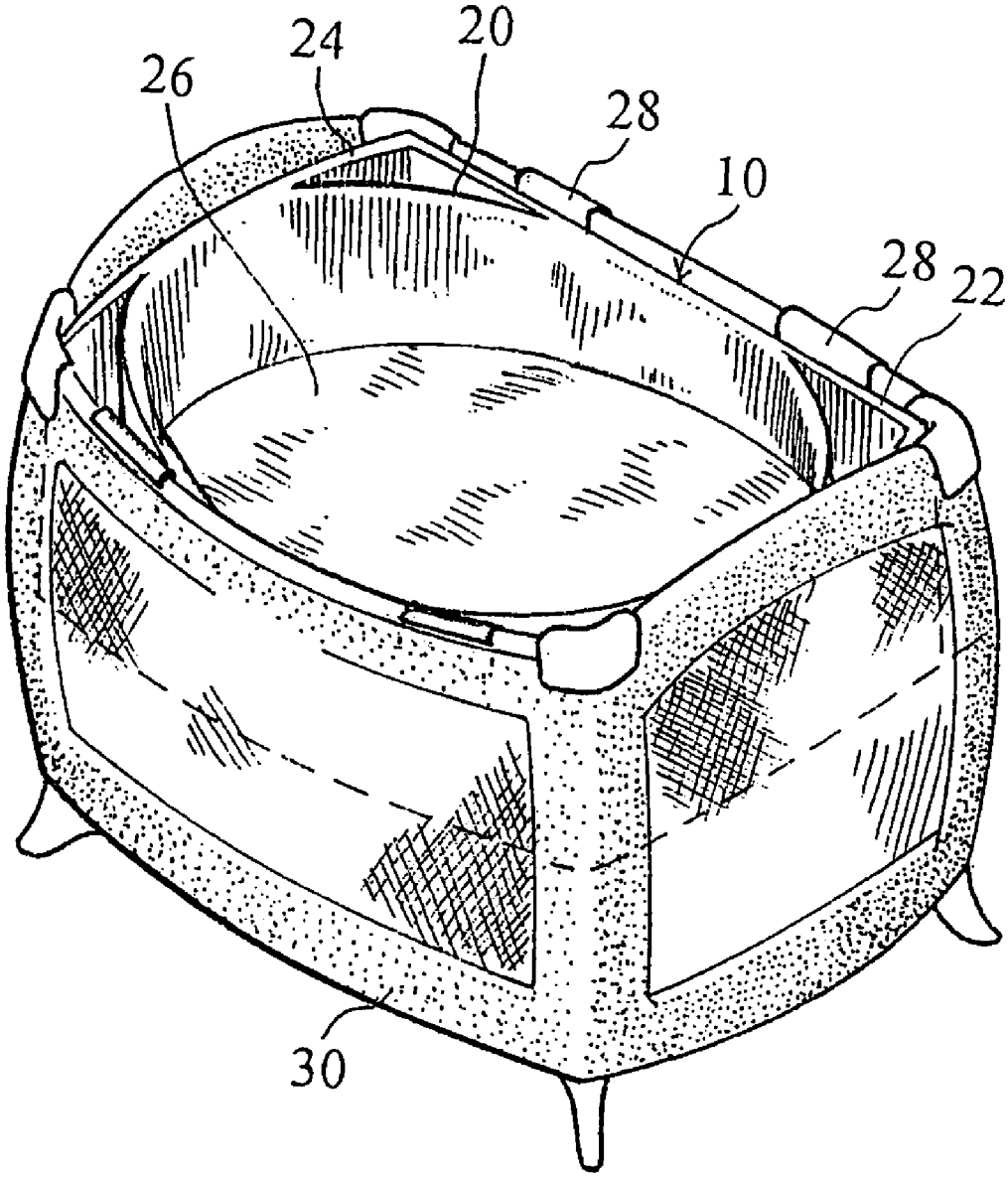
FIG. 2 is a perspective view showing the bassinet of this invention hung on a baby play yard.
Figure 3:
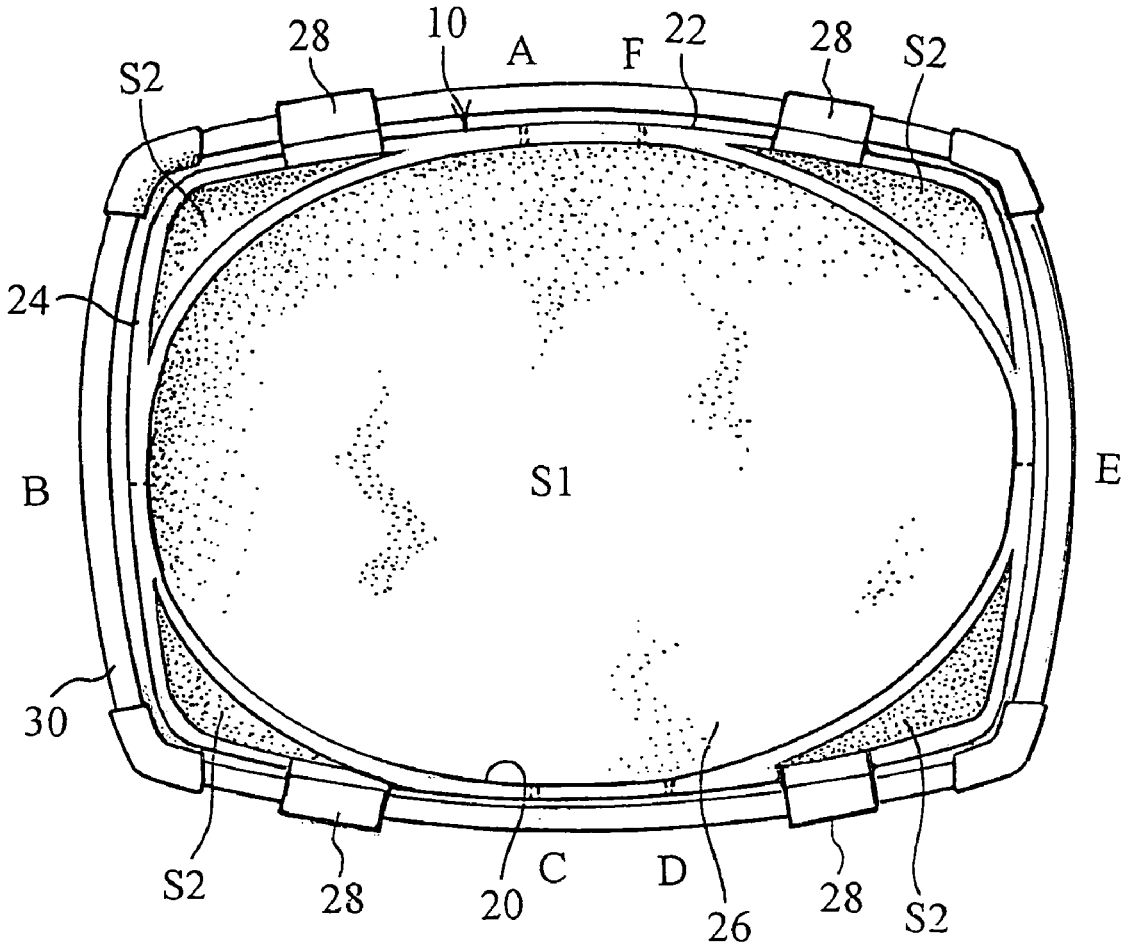
FIG. 3 is a schematic top view of the bassinet of this invention.

As shown in FIGS. 2 and 3, the bassinet of this invention comprises a peripheral main body 10 and an inner partition 20. The peripheral main body 10 can be hung on upper edges of a frame of a baby play yard 30. The peripheral main body 10 is substantially formed as a rectangular frame and stitched with clothes, which comprises two parallel longitudinal side faces 22, two parallel lateral side faces 24 perpendicular to the two longitudinal side faces 22, and a bottom 26. The upper edges of the two longitudinal side faces 22 are provided with plastic hooks 28 for hanging on the upper edges of the frame of the play yard 30. It should be understood that the means for hanging the bassinet on the play yard 30 is not the essential feature of this invention and can be any suitable conventional mechanism. For simplicity, the description relating to this aspect is omitted.

The inner partition 20 is provided in the interior of the peripheral main body 10 and substantially of an oval shape. The inner partition 20 is intersected with the four side faces 22, 24 of the peripheral main body 10 at six points (A, B, C, D, E, F). Two elastic pieces made of plastic flexible material are stitched into the inner partition 20 to form two arcs A-B-C and D-E-F, thereby to support and define the shape of the inner partition 20. Then, the six points (A, B, C, D, E, F) of the inner partition 20 are stitched and connect to the peripheral main body 10, so that the peripheral main body 10 is divided into an inner baby sleeping space S1 of oval shape and a peripheral compartments S2 for receiving articles.

With the above arrangement, the bassinet having compartments according to this invention has the following advantages. A user can still dispose the necessaries for the baby in the peripheral compartments S2 on the bassinet even the baby lies thereon. Since the compartments S2 and the baby sleeping space S1 are in the same plane as the bottom 26 of the bassinet, it is convenient for the user to take the articles without lifting the bassinet. Moreover, this invention is simple in structure and will not have an influence on the cost or price. Therefore, most customers will prefer this invention due to its multiple functions and inexpensive price.

While this invention has been described by the above embodiments, it should be understood that this invention is not limited to this. Various modifications can be easily thought of by those skilled in this art in view of the teaching of this invention. Therefore, as long as not departing from the spirit of this invention, such simple modification or equivalent change still falls in the scope of this invention defined by the appended claims.

LIST OF REFERENCE NUMERALS OF PRIMARY ELEMENTS

10 peripheral main body
20 inner partition
22 longitudinal side face
24 lateral side face
26 bottom
28 hook
30 play yard
S1 baby sleeping space
S2 compartment
M baby sleeping space
N compartment

What is claimed is:

1. A bassinet having compartments, said bassinet comprising a multi-sided peripheral main body and an inner partition connected to each side of the main body so as to divide the peripheral main body into a baby sleeping space and peripheral compartments spaced apart from each other for receiving articles, wherein the inner partition is of substantially an oval shape and formed of at least one elastic piece having the shape of an arc.

2. The bassinet having compartments according to claim 1, wherein the at least one elastic piece is made of a flexible material and stitched in the inner partition for supporting and defining the shape of the inner partition.

3. A bassinet having compartments, said bassinet comprising a pheripheral main body and an inner partition connected to each side of the main body so as to divide the peripheral main body into a baby sleeping space and peripheral compartments for receiving articles, wherein the peripheral compartments are formed at the corners of the main body, and said inner partition is of substantially an oval shape.

4. The bassinet having compartments according to claim 3, wherein elastic pieces made of flexible material are stitched into the inner partition for supporting and defining the shape of the inner partition.

* * * * *